United States Patent [19]

Cassia

[11] Patent Number: 4,560,093

[45] Date of Patent: Dec. 24, 1985

[54] TYPE OF DISPENSER IN PARTICULAR FOR LIQUID SOAP

[75] Inventor: Antonio M. Cassia, Milan, Italy

[73] Assignee: Steiner Company, Inc., Chicago, Ill.

[21] Appl. No.: 520,349

[22] Filed: Aug. 4, 1983

[30] Foreign Application Priority Data

Sep. 2, 1982 [IT] Italy ..... 22769/82[U]

[51] Int. Cl.[4] ..... B67D 5/06

[52] U.S. Cl. ..... 222/181; 222/214; 222/325

[58] Field of Search ..... 222/181, 185, 207, 209, 222/214, 325, 490

[56] References Cited

U.S. PATENT DOCUMENTS

| | | | |
|---|---|---|---|
| 1,326,880 | 12/1919 | Rose | 222/214 |
| 2,565,917 | 8/1951 | Hammerstein | 222/490 |
| 3,066,832 | 12/1962 | Rossetti | 222/214 |
| 3,870,201 | 3/1975 | Asplund | 222/214 |
| 3,926,347 | 12/1975 | Low et al. | 222/214 |
| 4,166,553 | 9/1979 | Fraterrigo | 222/207 |

*Primary Examiner*—H. Grant Skaggs

*Attorney, Agent, or Firm*—Emrich & Dithmar

[57] ABSTRACT

A dispenser for liquid soap having an external envelope consisting of a first body forming a removable housing seating for a container of liquid soap equipped with a dispensing nozzle, and of a second body movable with respect to said first body. The second body acts on the dispensing nozzle so that it dispenses measured amounts of liquid soap.

7 Claims, 4 Drawing Figures

FIG. 3
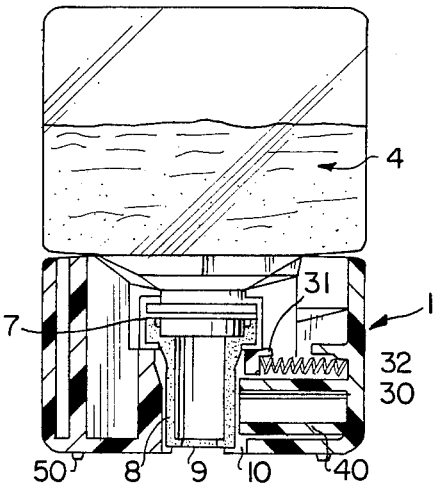
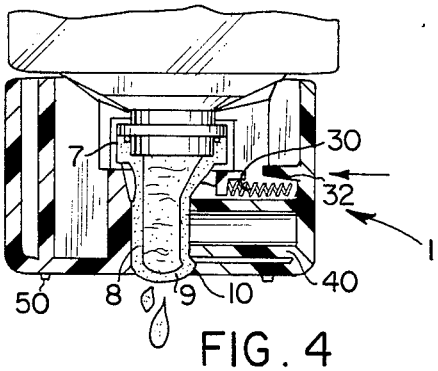
FIG. 4
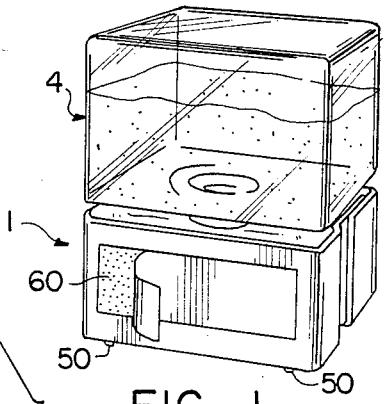
FIG. 1
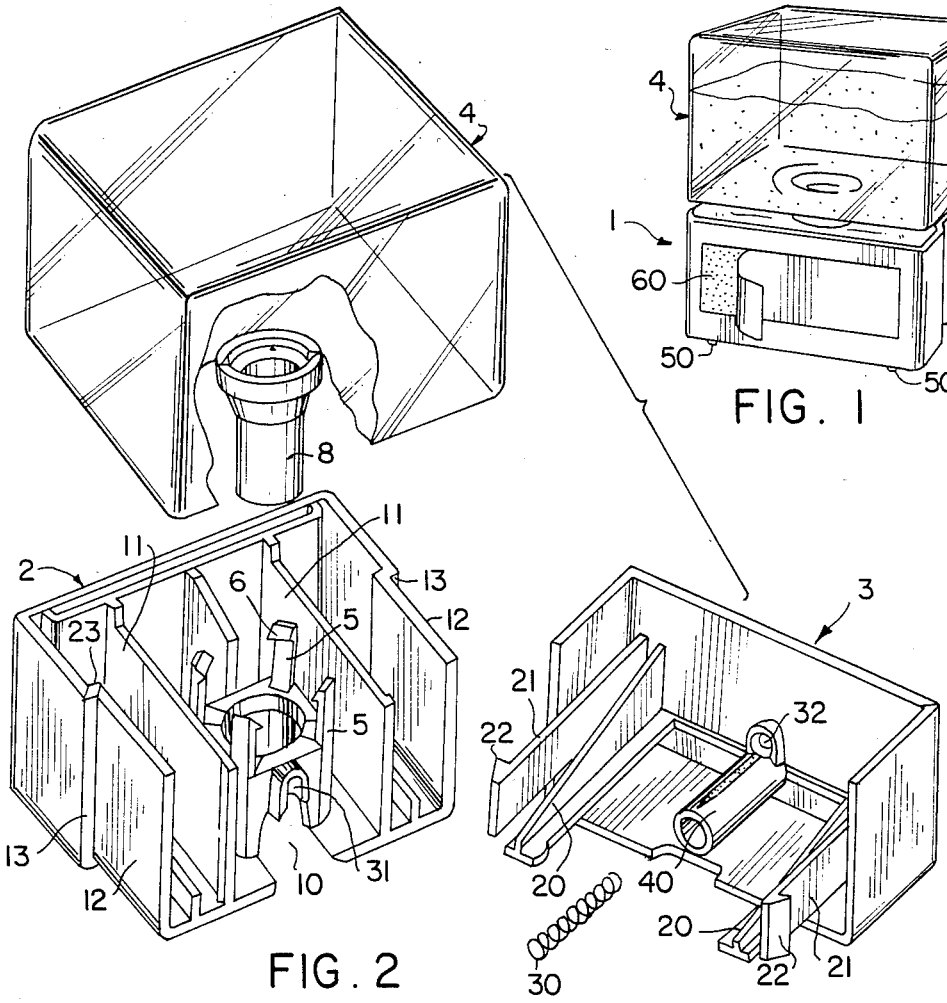
FIG. 2

TYPE OF DISPENSER IN PARTICULAR FOR LIQUID SOAP

BACKGROUND OF THE INVENTION

This invention refers to a type of dispenser in particular for liquid soap.

As is well known, family-type liquid soap dispensers are at present available on the market. Generally, they consist of a container whose top opening is closed by a cap equipped with a pumping element ending in a dispensing button set on the outside of the container.

With dispensers of this kind, first of all, the liquid soap, or similar substances, is dispensed through the pumping effect that is obtained by pushing the plunger. Consequently, the plunger itself has a complex structure, since it has to carry out the aspiration of the liquid soap from the container.

Besides, with dispensers of this kind, once all the liquid soap contained in the container has been dispensed, the whole thing has to be replaced, including the pumping element since, for its very structure, it cannot be used for too long or in any way reused.

SUMMARY OF THE INVENTION

The purpose of this invention is therefore to eliminate the disadvantages previously complained of by making a liquid soap dispenser that allows for a notable simplification of the working elements, without having to have recourse to an aspiration action on the liquid soap to be dispensed.

Within the general range of the purpose outlined above, a particular aim of this invention is to make a dispenser that can be used indifferently, depending on the particular requirements of its user, either as a wall dispenser or as a dispenser to be used manually, whenever the need arises for dispensing liquid soap.

Another purpose of this invention is to make a dispenser, in particular for liquid soap, such as will give the possibility, once the product is used up, of re-utilizing the greatest part of the dispenser, reducing in this way its cost.

A last but not least purpose of this invention is that of making a type of dispenser that, through the simplicity of its structural characteristics, can give the greatest guarantee of reliable working.

The above mentioned aim, in addition to the purpose pointed out and others that will be clarified later, is obtained by means of a type of dispenser in particular for liquid soap, according to this invention, characterized by the fact that it comprises an external envelope, consisting of a first body, forming the removable housing for a container of liquid soap or similar substances equipped with a dispensing nozzle and of a second body removable with respect to said first body, said second body acting on said dispensing nozzle in order to dispense measured quantities of liquid soap or similar substances.

Further characteristics and advantages will merge from the detailed description of a type of dispenser in particular for liquid soap shown by way of illustration only, with the help of the attached drawing in which:

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a perspective view of the dispenser;

FIG. 2 is an exploded perspective view of the dispenser, with portions broken away; and FIGS. 3 and 4 are views partially in elevation and partially in vertical section of the dispenser in two different application positions.

DESCRIPTION OF THE PREFERRED EMBODIMENT

With reference to the above mentioned figures, the structure of this dispenser in particular for liquid soap, according to this invention, comprises an external envelope, generally designated by the numeral 1, which consists of a first body 2 and a second body 3, which can be associated with the first body 2 and movable with respect thereto.

To be more detailed, second body 3 has a substantially box-like structure with two contiguous sides missing.

Said body 2 defines the housing for a removable container 4 of liquid soap or similar substances. Said first body 2 consists of a plurality of juts 5 which end in the upper part with a small tooth 6 able to engage the collar 7 of a dispensing nozzle that substantially consists of a cylindrical body 8 of an elastically deformable material terminating, at the base end, with a diametric slot 9 that makes the dispensing opening for the liquid and, at the same time, the means of closing the valve element.

The previously mentioned diametric slot 9 is set to correspond to a hole 10 on the lower surface of the first body 2.

First body 2 has some internal stiffening and guiding plates 11 and, on its external surface, on each of its lateral sides, a set-back part 12 forming, together with the lateral surface itself, a shoulder 13.

As previously mentioned, first body 2 is connectable to a second body 3, which also has a substantially box-like structure with two sides missing, that can engage by a sliding action with first body 2 and more precisely with the set-back parts 12 of the lateral sides of the first body 2.

The above mentioned second body 3 has inside it some guide protrusions 20 that can be housed to slide along channels limited by the above mentioned plates 11 and the lateral walls of the first body 2; also, the second body 3 has check stops, each consisting of a protrusion 21 that runs parallel to the guide protrusions 20 and ends with a pawl 22 able to engage on contact with a ledge 23 set on the first body 2 to prevent the accidental slipping of the second body 3 with respect to the first body 2.

The presence of the set-back parts 12 permits there to be a relative sliding between the first body 2 and the second body 3 and also to create a run-stopping element on the compression of the second body 3 towards the first body 2, while the run-stopping element preventing the slipping is made between the coupling of pawls 22 together with ledges 23.

Between the first body 2 and the second body 3 there function some elastic means consisting of a helical bias spring 30 set in a recess 31 defined internally by the second body 2 and a notch 32 formed in correspondence on the internal wall of the second body 3.

The second body 3 has then means for activating said container's dispensing nozzle 8, said means consisting of a protuberance 40 which develops from the second body 3 parallel to the guide protrusions 20, acting by contact on the lateral surface of the cylindrical body 8 of elastically deformable material.

In this way, by exercising a compression on the second body 3, a relative translation between the second body 3 and the first body 2 is obtained and a corresponding radial compression action on the rubber body 8, by means of the protuberance 40, that makes the diametric slot 9 open with the consequent dispensing and emission of a measured amount of liquid soap with corresponding and simultaneous sucking inside the container of an analogous amount of air.

Both the body 2 and the body 3 form on their lower side some supporting feet 50 to be used when the dispenser is used on a flat surface with the user obtaining output by compressing the second body 3.

If the dispenser has to be mounted on a wall to be used, on the back side of the second body 3 a double-adhesive tape 60 is provided that allows for the mounting of the dispenser on a wall and makes it possible for the user to use it still by squeezing the second body 3 that translates relatively to the first body 2.

The container 4 can be removably coupled in the seating formed inside the first body 2, so that, when the container 4 itself is empty, it is enough to replace only the container 4, not the whole dispenser as it happens with bottle-dispensers of type known.

What is described above shows therefore how this invention realizes the proposed aims and in particular the fact should be pointed out that providing a two-element external envelope makes it possible to use one part of the envelope itself directly as an activator taking advantage of sliding linkage between the first body and the second body.

In addition, another important aspect is constituted by the fact that by obtaining the dispensing of soap by gravity, it is not necessary to have pumping elements working through aspiration.

In practice the materials employed, in addition to the dimensions and the related forms, can be any whatever, according to the requirements.

I claim:

1. A dispenser for liquid soap disposed in a container equipped with a dispensing nozzle, said dispenser comprising: first and second bodies each in the form of a generally rectangular box-like structure with an open top and one open side, said bodies being cooperable with their open sides facing each other to form a substantially box-like open-top external envelope, said first body having lateral surfaces with set-back areas to engage said second body, and internal plates that cooperate with said lateral surfaces to engage guide elements protruding from said second body, run-stopping means to prevent slipping between said second and said first bodies consisting of juts protruding from said second body parallel to said guide elements and terminating with pawl-engaging ledges formed between said set-back areas and the lateral surfaces of said first body, and means on said envelope forming a seat for removably supporting the associated soap container, said envelope having an opening therein for receiving the dispensing nozzle when the container is supported thereon, said second body being slidably movable with respect to said first body for engagement with the dispensing nozzle to dispense a measured amount of liquid soap.

2. A dispenser of the type set forth in claim 1 wherein said seat of said soap container consists of a plurality of juts ending in the upper part with teeth which snap engage a collar on said dispensing nozzle.

3. A dispenser of the type set forth in claim 2 wherein said dispensing nozzle has a cylindrical element of elastically deformable material, which has a diametric slot therein.

4. A dispenser of the type set forth in claim 3, and further providing bias means acting between said first body and said second body.

5. A dispenser of the type set forth in claim 4, wherein said second body has a protrusion that engages said dispensing nozzle to compress radially said cylindrical element by compression of said bias means between said second body and said first body.

6. A dispenser of the type set forth in claim 5, and further including supporting feet on the lower surfaces of said first and said second bodies.

7. A dispenser of the type set forth in claim 6, and further including on the back surface of said first body a double-adhesive tape for the wall-mounting of said dispenser.

* * * * *